US007752716B2

(12) United States Patent
Babasaki

(10) Patent No.: US 7,752,716 B2
(45) Date of Patent: Jul. 13, 2010

(54) PORTABLE-DEVICE HOLDING CLIP

(75) Inventor: Shuichi Babasaki, Izumi (JP)

(73) Assignee: Icom Incorporated (JP)

( * ) Notice: Subject to any disclaimer, the term of this patent is extended or adjusted under 35 U.S.C. 154(b) by 492 days.

(21) Appl. No.: 11/823,433

(22) Filed: Jun. 27, 2007

(65) Prior Publication Data

US 2008/0172841 A1 Jul. 24, 2008

(30) Foreign Application Priority Data

Jan. 18, 2007 (JP) ..... 2007-008768

(51) Int. Cl.
*A45F 5/02* (2006.01)

(52) U.S. Cl. ..... 24/3.11; 381/364; 24/3.12; 24/3.1; 224/669; 224/197

(58) Field of Classification Search ..... None
See application file for complete search history.

(56) References Cited

U.S. PATENT DOCUMENTS 4,100,653 A 7/1978 Sensabaugh
5,052,081 A 10/1991 Fuehrer
5,564,610 A * 10/1996 Barron ..... 224/268
5,806,146 A 9/1998 Chen
6,993,370 B2 1/2006 Chen

FOREIGN PATENT DOCUMENTS

JP 55-087074 7/1980
JP 3094346 3/2003
JP 3773707 2/2006

* cited by examiner

*Primary Examiner*—Jack W. Lavinder
(74) *Attorney, Agent, or Firm*—Baker & McKenzie LLP

(57) ABSTRACT

Elastic force originating from an elastic body is applied to gripping portions, so that a lower member and an upper member functions as a clip. An elastic member is formed in such a manner as to be cut out from an attachment surface of the lower member along the contour (other than a portion thereof) of a closed figure, and can warp with respect to the attachment surface with that portion taken as a warp axis. The elastic member has a projection on the leading end thereof, and a rear panel has a recess in an attachment surface thereof. When the rear panel is rotated with respect to the lower member, the projection is disengaged from the recess by warping of the elastic member, or engaged with the recess by a retroaction of the warping.

15 Claims, 10 Drawing Sheets

X1–X1 CROSS-SECTIONAL VIEW

X2–X2 CROSS–SECTIONAL VIEW

X3—X3 CROSS-SECTIONAL VIEW

PORTABLE-DEVICE HOLDING CLIP

BACKGROUND OF THE INVENTION

1. Field of the Invention

The present invention relates to a portable-device holding clip.

2. Description of the Related Art

Conventionally, clips for portable devices, such as a microphone, a cellular phone, and various portable electronic devices have been proposed. Here, a clip means one which can hold a portable device in an appropriate mode or posture, and is attachable to and detachable from the clothing or the like of a user of the portable device. Having such a clip makes it possible for the user to use the portable device while attaching the portable device to a suitable location in the body of the user.

In this case, it is preferable that the clip should have a suitable rotation mechanism in accordance with the posture of the portable device. This is because, in a case where the portable device is a microphone, it is convenient if the posture of the microphone can be changed optionally in accordance with the posture or the like of the user.

As such portable-device holding clips, Japanese Utility Model Application KOKAI Publication No. S55-87074 and U.S. Pat. No. 4,100,653 disclose a technology for a support structure of a compact microphone or the like which has a clip rotatably attached to the outer shell of the compact microphone/speaker in such a way that the direction of the compact microphone/speaker can be changed optionally, and a technology for an arrangement for rotatably attaching a microphone/speaker to a thin object like a clothing.

SUMMARY OF THE INVENTION

Japanese Utility Model Application KOKAI Publication No. S55-87074 discloses a technology for the support structure of a compact microphone or the like which has a clip rotatably attached to the outer shell of the compact microphone/speaker in such a way that the direction of the compact microphone/speaker can be changed optionally.

According to the foregoing technology, however, the number of constituent components is large, so that assembling is not easy. The large number of constituent components results in cost up, or increases the weight of the clip itself. Further, according to the foregoing technology, a source which generates force for fixing the posture of the compact microphone/speaker is a spring washer only, so that sufficient fixing force may not be obtained.

U.S. Pat. No. 4,100,653 discloses a technology for an arrangement which is for rotatably attaching a microphone-speaker to a thin object like a clothing, and comprises a plurality of depressions formed in a metallic plate or the like, a spring having projections to be engaged with the depressions, and a clip or the like attached to the spring in such a manner as to perform axial rotation. That is, the engagement of the depressions with the respective projections is utilized for fixing the posture of the microphone-speaker.

However, if the spring and means for resiliently urging a clip in claim 1 (see, the constituent component e) are formed of separate members, the same problems as those of Japanese Utility Model Application KOKAI Publication No. S55-87074 arise.

U.S. Pat. No. 4,100,653 also discloses an embodiment where the foregoing spring functions as a source of supplying elastic force for attaching the clip already fitted to the microphone-speaker to a clothing or the like, and as a source of supplying elastic force for maintaining the rotation posture of the microphone-speaker (see, the embodiment, drawings, and claim 5). According to this embodiment, the number of parts is reduced, thereby overcoming the foregoing problems.

According to the embodiment, however, there is a following problem. That is, when elastic force is increased to ensure the fixing of the posture of the microphone-speaker, it becomes difficult to release the projections of the spring from the depressions, so that changing the posture of the microphone-speaker becomes difficult. In contrast, if the elastic force is reduced, this results in weakening of holding force of the microphone-speaker in rotation.

Further, according to the foregoing embodiment, to rotate the microphone-speaker, first, the projections are pulled out from the depressions against the elastic force of the spring, and then the microphone-speaker is rotated while maintaining that pulled-out state. At this time, in particular, in the second step, the user needs to simultaneously carry out pull-out operation and rotation operation which have different vectors from each other, and it is somehow inconvenient. According to the foregoing embodiment, there is a little problem regarding a good operability.

The present invention has been made in view of the foregoing problems, and it is an object of the invention to provide a portable-device holding clip which enables effective holding of a portable device and attachment/detachment thereof with respect to a clothing or the like with a simple structure.

Moreover, another object of the present invention is to provide a portable-device holding clip which enables effective holding of the portable device and attachment/detachment thereof to a clothing or the like with a good operability.

To achieve the objects, a portable-device holding clip according to the present invention holds a portable device and is attachable to and detachable from a certain thin object, and comprises: a first member which has a first gripping portion and holds the portable device; a second member having a second gripping portion which can abut against the first gripping portion with the certain thin object in between; and an elastic body generating elastic force which is applied between the first gripping portion and the second gripping portion and causes the first gripping portion and the second gripping portion to come in contact with each other; and wherein the first member further has: an attachment portion having an opposed surface which faces an attachment surface of the portable device; a rotation shaft which is attached to the attachment portion, passes through the attachment surface of the portable device, and holds the portable device in such a way that the portable device is rotatable around an axis of the rotation shaft with respect to the first member; an elastic member having a linkage portion which constitutes a part of a contour of the elastic member, and is connected to the opposed surface or a surface connected to the opposed surface in a elastically deformable manner; and a projection which can engage with one of a plurality of recesses formed in the attachment surface in such a manner as to be arranged on a circular arc away from a center of the rotation shaft by a predetermined distance, and is provided at a leading end of the elastic member, the elastic member is arranged in such a manner as to be retained in an opening formed in the opposed surface and formed in a shape corresponding to the contour of the elastic member, the elastic member being able to warp with respect to the opposed surface around the linkage portion, and the projection is disengaged from the recess by warping of the elastic member or engaged with the recess by a retroaction of the warping when the portable device is rotated with respect to the first member.

According to the portable-device holding clip of the present invention, elastic force originating from the elastic body may exert on the elastic member at least when the projection engages with the recess.

According to the portable-device holding clip of the present invention, the first member and the elastic member may be formed by integral molding.

According to the portable-device holding clip of the present invention, the first member may be made of a resin material.

According to the portable-device holding clip of the present invention, the projection and the recess may be both formed in an approximately semispherical shape.

The portable-device holding clip of the present invention, may further comprise a coupler means, a coupler structure or a coupler portion which couples the first member and the second member together in such a way that the first member and the second member are rotatable around a predetermined axis, and wherein the first gripping portion and the second gripping portion are located at respective one side ends of the first member and the second member with the predetermined axis taken as a boundary, and the elastic body applies elastic force, which causes the first member and the second member to be apart from each other, between respective other sides of the first member and the second member with the predetermined axis taken as a boundary.

In the mode where the coupler means, the coupler structure or the coupler portion is employed, the coupler means, the coupler structure or the coupler portion may have first and second protrusions provided at either one of the first member and the second member, first and second engagement holes provided in the other one of the first member and the second member and engaged with the first and second protrusions, respectively, and first and second grooves communicated with the first and second engagement holes, respectively, and each having a width through which the first or second protrusion can pass, the protrusion may pass through the groove to engage with the engagement hole, and an engagement portion where the first protrusion engages with the first engagement hole and an engagement portion where the second protrusion engages with the second engagement hole may be present on the predetermined axis.

According to the portable-device holding clip of the present invention, the first member and the second member may respectively comprise a solid body formed in an approximately rectangular-solid-like shape.

According to the portable-device holding clip of the present invention, a plurality of projections may be provided at the leading end of the elastic member, and the plurality of projections may engage with the respective recesses at a same time.

According to the portable-device holding clip of the present invention, the elastic body may comprise a leaf spring.

According to the portable-device holding clip of the present invention, the elastic body may comprise a coil spring.

BRIEF DESCRIPTION OF THE DRAWINGS

These objects and other objects and advantages of the present invention will become more apparent upon reading of the following detailed description and the accompanying drawings in which:

FIG. 10A shows the coupler without the rib, and FIG. 10B shows the coupler with the rib;

DETAILED DESCRIPTION OF THE PREFERRED EMBODIMENTS

An embodiment of the present invention will be explained below with reference to FIGS. 1 to 10.

Figure 2:
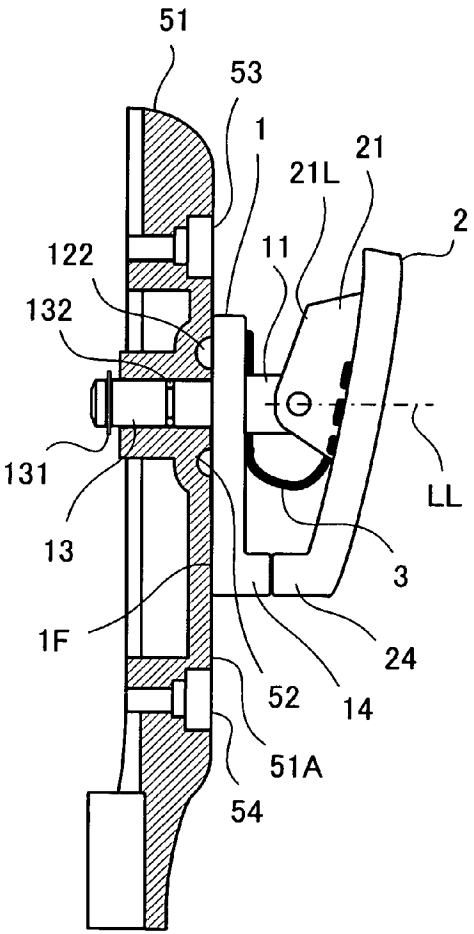
FIG. 2 is a side view (partially cross-sectional view) showing the portable-device holding clip.
Figure 1:
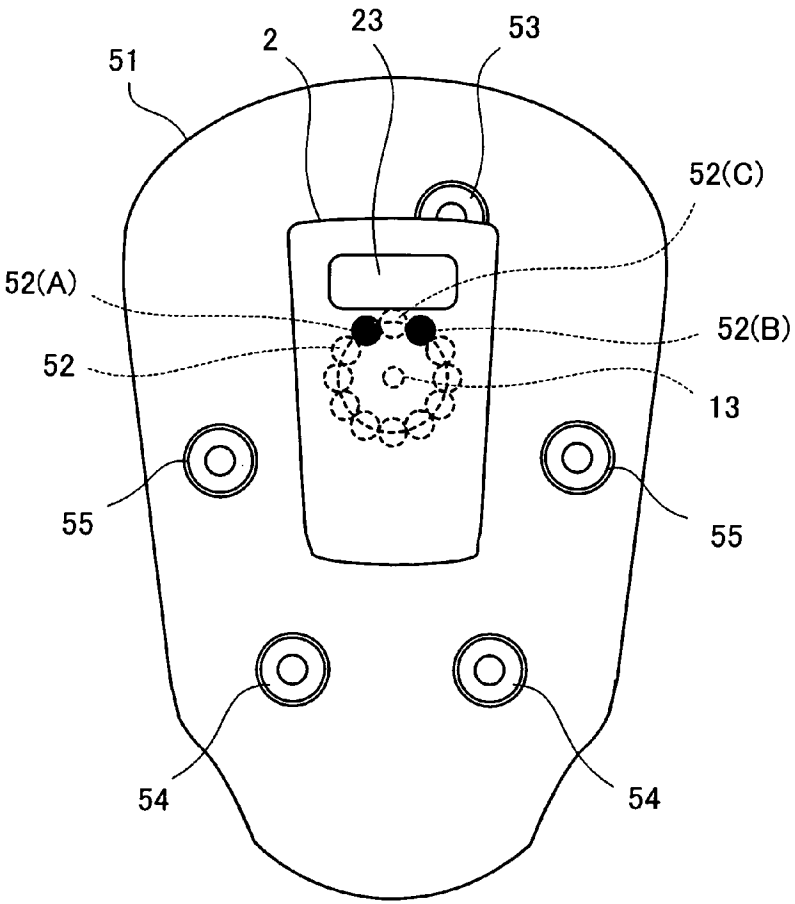
FIG. 1 is a top plan view showing a portable-device holding clip according to an embodiment of the present invention.

As shown in FIGS. 1 and 2, a portable-device holding clip of the embodiment has a lower member 1, an upper member 2, and a rear panel 51. As will be apparent from the following explanation, the lower member 1 and the upper member 2 constitute a clip.

The lower member 1 and the upper member 2 are each formed in an approximately rectangular-solid-like shape having a thin width (length in the horizontal direction in FIG. 2). The lower member 1 and the upper member 2 have a first coupler 11 and a second coupler 21, respectively, on the wide face of the rectangular solid thereof.

The first coupler 11 protrudes from the wide face of the lower member 1. The first coupler 11 is formed in an approximately rectangular-solid-like shape lengthened in the lateral direction in the figure. The corner portion of the leading end thereof is rounded, and is formed in such a shape that a semicircle is connected to the one end of a rectangular, as viewed from the side as shown in FIG. 3.

Figure 4:
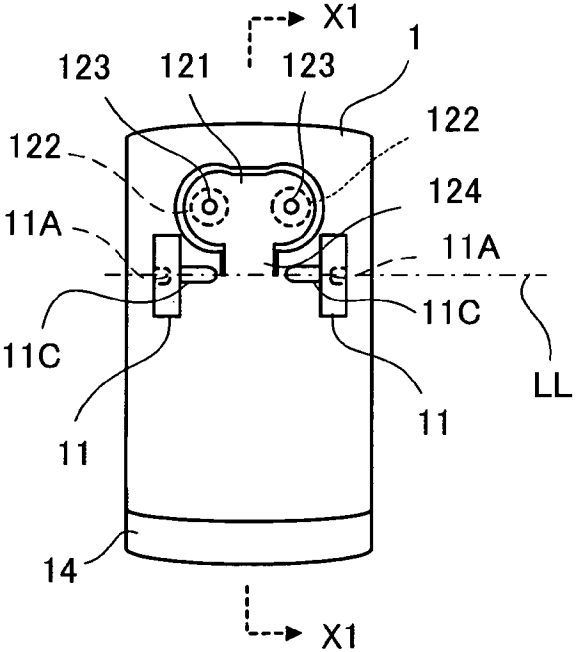
FIG. 4 is a top plan view showing the lower member.

As shown in FIG. 4, such a first coupler 11 has two portions provided across the center line in the width direction (horizontal direction in FIG. 4) of the lower member 1. Engagement holes 11A are respectively formed in the outward faces of the two portions. A groove 11B which is communicated with the engagement hole 11A is also formed in the outward face. As will be discussed later, the groove 11B has a width through which a protrusion 21A can pass.

Figure 3:
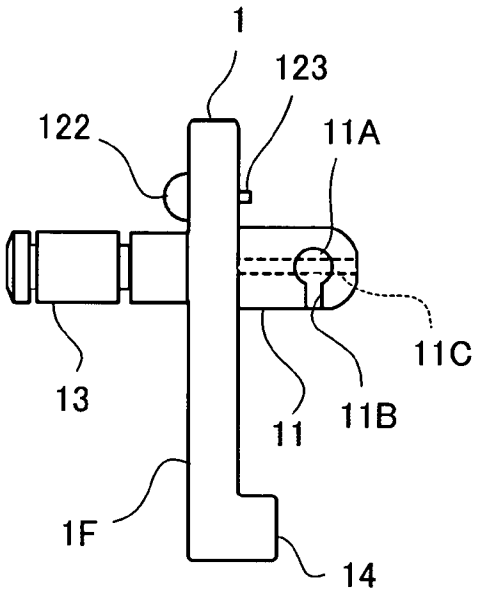
FIG. 3 is a side view showing a lower member.

As shown in FIGS. 3 and 4, ribs 11C are respectively formed on the inward faces of the two portions. The rib 11C is a portion which protrudes from the inward face. The rib 11C has a length which is equal to the entire length of the first coupler 11 in the horizontal direction in FIG. 3.

Figure 6:
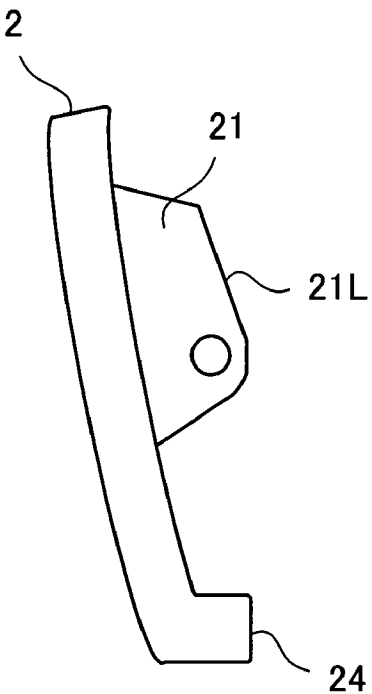
FIG. 6 is a side view showing an upper member.

The second coupler 21 protrudes from the wide face of the upper member 2. The second coupler 21 is formed in an approximately trapezoidal shape lengthened in the vertical direction as viewed from the side as shown in FIGS. 2 and 6. An inclined edge 21L which constitute a part of this shape faces the wide face of the lower member 1. It is preset that an angle between the inclined edge 21L and the wide face becomes a predetermined sharp angle. As will be apparent from FIGS. 6 and 7, the second coupler 21 has two portions like the first coupler 11.

Figure 7:
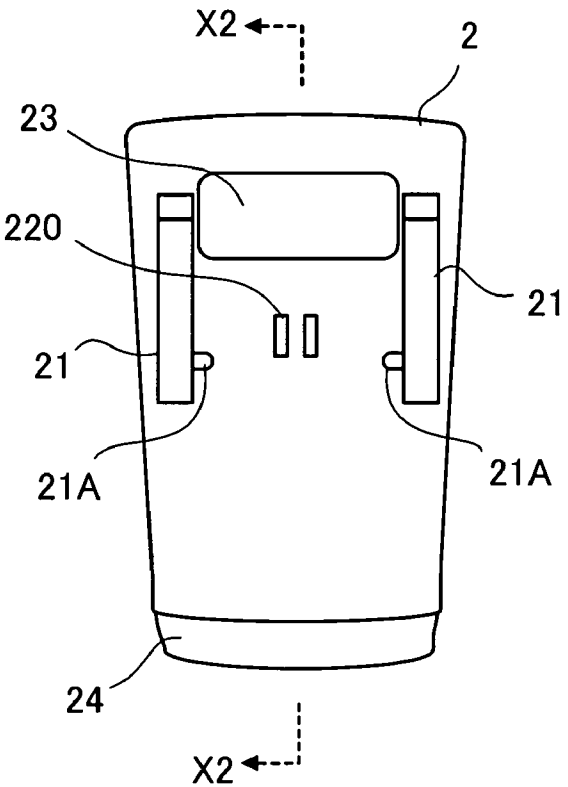
FIG. 7 is a top plan view showing the upper member.

As shown in FIG. 7, the protrusions 21A are formed on the respective opposed surfaces of the two portions which constitute the second coupler 21. The protrusion 21A passes through the groove 11B, and engages with the engagement hole 11A. The protrusion 21A and the engagement hole 11A each have a circular contour, so that the first coupler 11 (or the second coupler 21) can rotate with respect to the second coupler 21 (or the first coupler 11) around the centers of the protrusion 21A and the engagement hole 11A.

The lower member 1 and the upper member 2 are connected together by an elastic body 3. As will be apparent from FIG. 9, the elastic body 3 is a leaf spring. The elastic body 3 can be formed of, for example, an appropriate metal.

As shown in FIG. 9, the elastic body 3 is formed in an approximately letter L shape as viewed from the side. However, an angle between one side and the other side both forming the letter L is smaller than 90 degree. Lower-member attachment holes 321 are formed in the end portion of the one side of the letter L. In response to those holes, the lower member 1 has attachment protrusions 123 as shown in FIG. 4. The attachment protrusions 123 are located within that region where an elastic member 121 to be discussed later is formed, so that the elastic member 121 receives elastic force from the elastic body 3, as this will be discussed in detail later.

Figure 8:
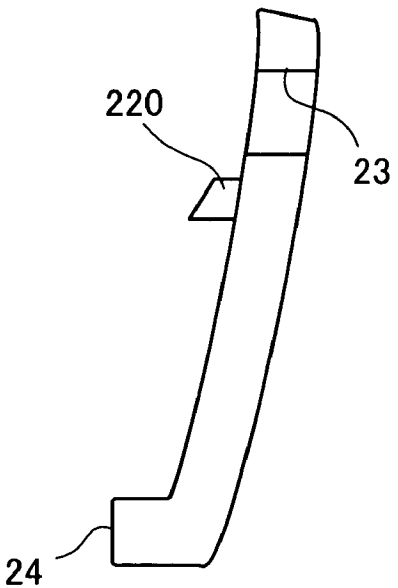
FIG. 8 is a cross-sectional view along a line X2-X2 in FIG. 7.

On the other hand, an upper-member attachment groove 322 is formed at the end portion of the other side of the letter L. In response, as shown in FIGS. 7 and 8, the upper member 2 has attachment protrusions 220.

Figures 9A, 9B, 9C, 9D:
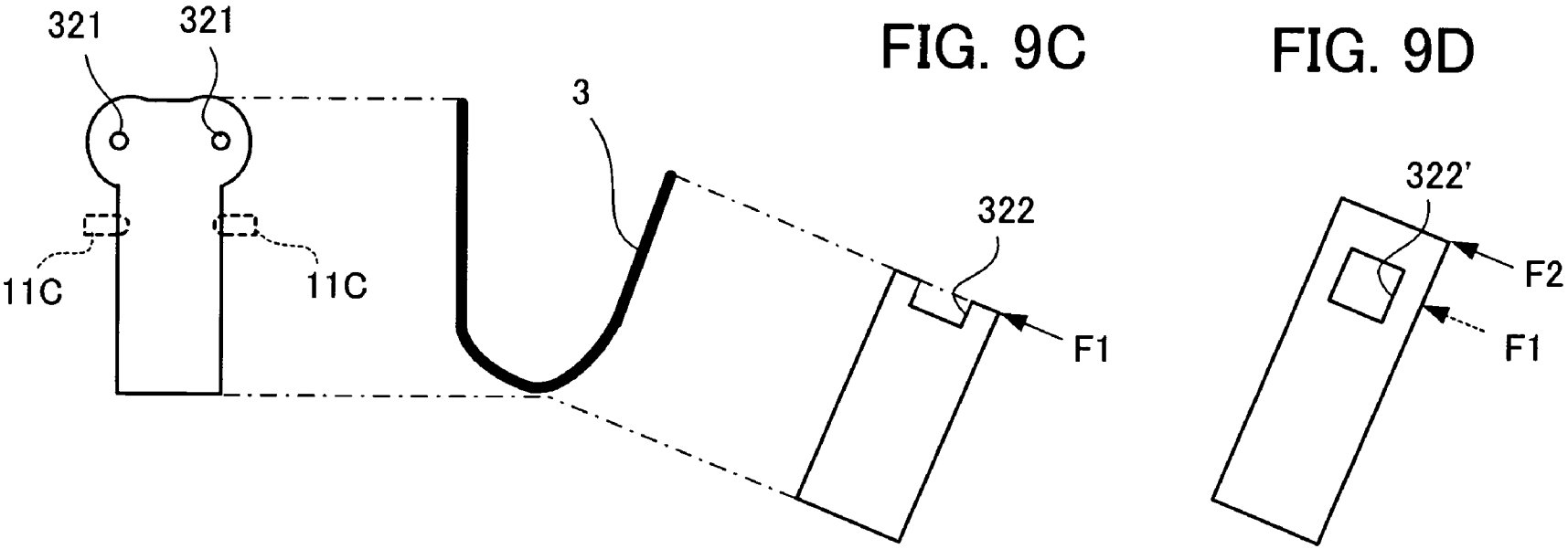
FIG. 9A is a first top plan view of an elastic body.
FIG. 9B is a side view thereof.
FIG. 9C is a second top plan view thereof.
FIG. 9D is a diagram showing another embodiment relating to the second top plan view of FIG. 9C.

According to the present invention, as shown in FIG. 9D, an attachment hole 322' may be formed instead of the upper-member attachment groove 322. In comparison with this case, the case shown in FIG. 9C is suitable for using the elastic body 3 for a relatively long time. This is because in the case shown in FIG. 9D, in comparison with the case shown in FIG. 9C, a point of action of force applied between the upper member 2 and the elastic body 3 (see, arrows F1 and F2 in FIGS. 9C and 9D, respectively) is located away from the bent portion of the elastic body 3 (corner of the letter L) which mainly produces elastic force. Accordingly, in the case shown in FIG. 9D, large force is likely to be applied to the elastic body 3 in comparison with the case shown in FIG. 9C, the progression of the fatigue thereof is further accelerated.

The elastic body 3 has those holes or the groove and the protrusions engaged with one another. That is, the protrusions 123 engage with the respective holes 321, and the protrusions 220 engage with the groove 322, so that the elastic body 3 is held between the lower member 1 and the upper member 2 as shown in FIG. 2. In this holding, force which causes the one side of the letter L of the elastic body 3 and the other side thereof to come close together is applied by the lower member 1 and the upper member 2. As a result, elastic forces originated from the elastic body 3 are applied between the lower member 1 and the upper member 2.

More specifically, elastic force which causes the lower ends of the lower member 1 and the upper member 2 to come close to each other is applied therebetween, and on the other hand, elastic force which causes the upper ends of the lower member 1 and the upper member 2 to come off to each other is applied therebetween. As will be apparent from the disposing state of the elastic body 3, a boundary where the effecting directions of the elastic forces are reversed is a horizontal line LL which extends in the horizontal direction and includes that portion where protrusion 21A of the second coupler 21 engages with the engagement hole 11A of the first coupler 11 (to be more precise, rotation centers thereof).

The lower member 1 and the upper member 2 have a first gripping portion 14 and a second gripping portion 24, respectively, formed along the respective lower ends. The first gripping portion 14 and the second gripping portion 24 abut against each other by applying elastic force from the elastic body 3. When both gripping portions abut against each other with a clothing or the like in between, the portable-device holding clip of the embodiment can be attached to the clothing or the like. Thus, the lower member 1 and the upper member 2 function as a clip.

At this time, the inclined edge 21L of the second coupler 21 and the rib 11C of the first coupler 11 function effectively. This is because of the following reason.

That is, when it is attempted to cause a clothing or the like to be sandwiched between the first gripping portion 14 and the second gripping portion 24, it is necessary to cause both gripping portions to be apart from each other. At this time, force which causes the upper ends of the lower member 1 and the upper member 2 to come close to each other is to be applied against the elastic force from the elastic body 3. At this time, it is preferable that both edges should not be come close to each other so much because if they come close to each other so much, unnecessary force is applied to the elastic body 3 and the degree of fatigue thereof is increased or a possibility such that the elastic body 3 is damaged is increased.

In contrast, according to the embodiment, as mentioned above, because the inclined edge 21L which forms a predetermined sharp angle with the wide face of the lower member 1 is present, a possibility such that the upper ends of the lower member 1 and the upper member 2 come close to each other beyond necessity is extremely reduced. This is because when both edges comes close to each other more than a predetermined distance, the wide face of the lower member 1 and the inclined edge 21L contact with each other. That is, the second coupler 21 including the inclined edge 21L functions as a stopper which keeps the coming-margin distance between the upper ends of the lower member 1 and the upper member 2 appropriately.

According to the embodiment, because of the presence of the second coupler 21 including the inclined edge 21L, there is an advantage such that the elastic body 3 can be used for a long time.

To effectively obtain the foregoing working and effectiveness, it is preferable that the predetermined sharp angle should be set to 3 to 70 degree or so, and more preferably, 5 to 45 degree. If the sharp angle is too small, attachment to a relatively thick clothing becomes difficult, and if it is too large, the foregoing stopper function becomes voided.

In addition, according to the embodiment, because of the presence of the rib 11C, a possibility such that unnecessary force is applied to the elastic body 3 is further reduced. This is because of the following reason. That is, the protruding ends of the ribs 11C represented by the dashed lines in FIG. 9A contact the elastic body 3. It would be assumed a case where the elastic body 3 is attached as shown in FIG. 4. Specifically, this contact portion is located on a surface which is opposite to that surface where the elastic body 3 contact the upper member 2, and which constitutes the elastic body 3.

Figure 10B:
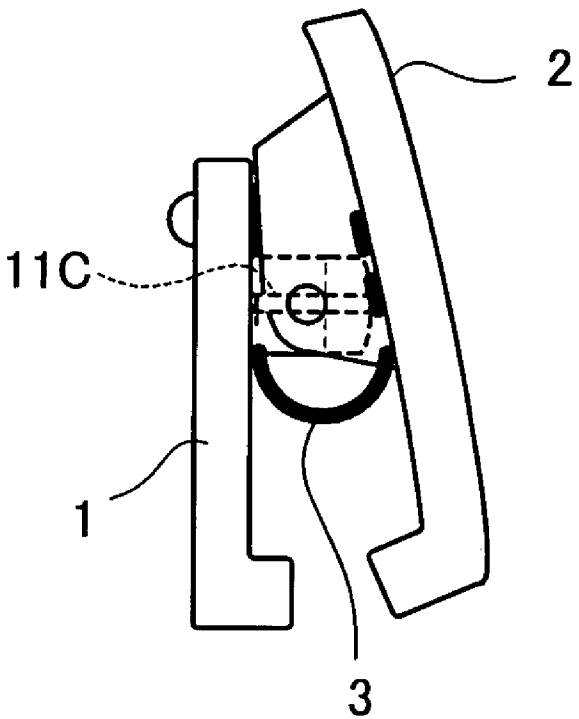
FIG. 10A and FIG. 10B are diagrams for explaining the function of a rib formed on a first coupler.
Figure 10A:
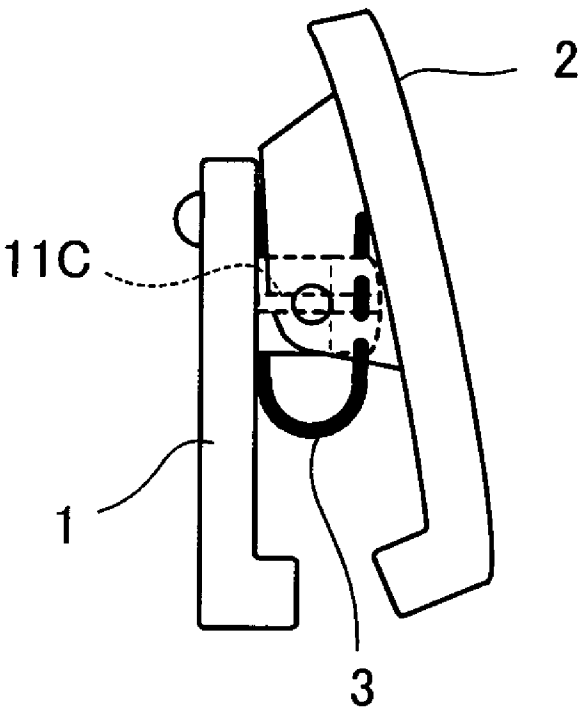

Because of the presence of such a contact portion, the motion of the elastic body 3 is limited to a certain extent when the respective upper ends of the lower member 1 and the upper member 2 come close to each other. More specifically, as will be apparent from the comparison between FIG. 10A and FIG. 10B, in the motions of the elastic body 3, a motion such that the elastic body 3 itself enters into a region sandwiched between the two portions of the first coupler 11 is limited. Note that FIG. 10A illustrates the way how the elastic body 3 enters into the sandwiched region. This means that the bent portion of the elastic member 3 does not curl beyond necessity as shown in FIG. 10B in the result.

As a result, according to the embodiment, an advantage such that the elastic body 3 can be used for a long time is achieved also because of the presence of the rib 11C.

The bent portion of the elastic body 3 is free from both lower member 1 and upper member 2, so that when the motion of the elastic body 3 is limited, the bent portion makes a motion as to come close to the upper member 2 from the previous state. This motion is like a compensation with respect to the limitation.

It is not illustrated in the figure, but respective abutting surfaces of the first gripping portion 14 and the second gripping portion 24 may be provided with protrusions and recesses which engage with one another. This further ensures attachment to a clothing or the like.

As shown in FIG. 2, the rear panel 51 is attached to the lower member 1.

With the rear panel 51 being attached to the lower member 1, an attachment surface 51A faces an attachment surface 1F of the lower member 1. Particularly, in the embodiment, both attachment surface 51A and attachment surface 1F are planes having no particular concavity and convexity as shown in FIG. 2.

A portable device, such as a microphone, a cellular phone, or various portable electronic devices (not shown) is fixed and held on a surface opposite to the attachment surface 51A of the rear panel 51 (left side in FIG. 2). To fix and hold the portable device, as shown in FIG. 1, the rear panel 51 has a plurality of attachment holes 53, 54, and 55.

With the rear panel 51 being attached to the lower member 1, a rotation shaft 13 provided on the wide face of the lower member 1 in such a manner as to protrude therefrom completely passes through the rear panel 51 including the attachment surface 51A as shown in FIG. 2. The rear panel 51 is held by the rotation shaft 13.

However, a certain clearance is provided between a hole in the rear panel 51 through which the rotation shaft 13 passes through and the peripheral surface of the rotation shaft 13, so that the rear panel 51 and the lower member 1 can relatively rotate around the rotation shaft 13.

The rotation shaft 13 has two grooves in the axial direction thereof. The outward groove (left in FIG. 2) is provided with an E ring 131, while the inward groove (right in FIG. 2) is provided with an O ring. The E ring 131 regulates the relative motion of the rear panel 51 with the rotation shaft 13 in the axial direction. The O ring 132 prevents water from entering along the rotation shaft 13 from the right in FIG. 2, thereby protecting the portable device which is to be located at the left in FIG. 2 against the water.

The above explained lower member 1, upper member 2 and rear panel 51 are all formed of appropriate resin materials. As a result, the relatively lightweight portable-device holding clip can be provided.

The lower member 1 has an elastic member 121 in addition to the foregoing constituent components.

The elastic member 121 in the embodiment is formed in a shape shown in FIG. 4 in detail. That is, the contour of the upper part of the elastic member 121 in the figure is constituted by a first oblong which is lengthened in the horizontal direction rather than the vertical direction, and two circles arranged in such a manner as to overlap the respective ends of the first oblong. On the other hand, the contour of the lower part of the elastic member 121 in the figure is constituted by a second oblong which is connected to the middle portion of the first oblong and is lengthened in the vertical direction rather than the horizontal direction in the figure. The lower side of the second oblong in the figure has an integral connection with the lower member 1 (hereinafter, this connected portion is called "linkage portion 124" with reference to FIG. 4).

As explained, the elastic member 121 has the contour like a closed figure cut out from the lower member 1 and constituted by the first oblong, the two circles and the second oblong. The elastic member 121 having such a contour is arranged in such a manner as to be retained in an opening formed in the lower member 1 and the attachment surface 1F and having a similar contour.

However, the elastic member 121 maintains the integrity with the lower member 1 by the linkage portion 124 which constitutes a part of the contour of the elastic member 121. The maintenance of the integrity can be obtained well by integral molding of the elastic member 121 with the lower member 1 beforehand.

Figure 5:
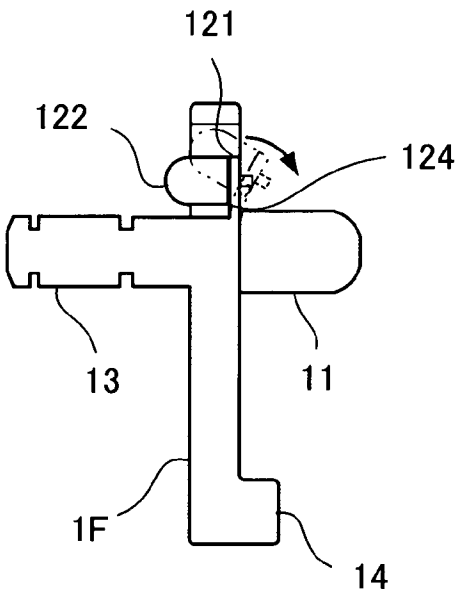
FIG. 5 is a cross-sectional view along a line X1-X1 in FIG. 4.

As shown in FIG. 5, the elastic member 121 can warp with respect to the attachment surface 1F with the linkage portion 124 taken as an axis.

How much force should be applied to cause the elastic member 121 to be warped or how much the elastic member 121 can warp in a degree, or the like (hereinafter called "warping capacity" to make the explanation simple) depends on the entire size of the elastic member 121, the length (or width) of the linkage portion 124, and what material the linkage portion 124 is made of, etc.

As mentioned above, in the embodiment, as shown in FIG. 4, the attachment protrusions 123 for attaching the elastic body 3 are formed in such a manner as to be located within the contour of the elastic member 121; to be more precise, the attachment protrusions 123 are located at the respective centers of the two circles which constitute the contour of the elastic member 121. As will be apparent from FIG. 2 or FIG. 4, the attachment protrusions 123 are located above the horizontal line LL in the figure.

Accordingly, elastic force from the elastic body 3 is applied to the elastic member 121, and the direction of application is toward the inside of FIG. 4 (left in FIG. 2).

Therefore, the warping capacity also varies depending on the ability of elastic force originating from the elastic body 3.

The elastic member 121 has two projections 122 each formed in a semispherical shape and at the leading end of the elastic member 121. With reference to FIG. 4, the projections 122 are arranged in such a manner as to be located at the respective centers of the two circles which constitute the contour of the elastic member 121, like the attachment protrusions 123. However, the projections 122 are formed on a surface opposite to that surface where the attachment protrusions 123 are formed.

The attachment surface 51A of the rear panel 51 has recesses 52 each of which is formed in a semispherical shape and can engage with the projection 122. As shown in FIG. 1, the recesses 52 are arranged on the circumference of a circle having a predetermined radius from the central axis of the rotation shaft 13.

A distance between one recess 52 and another adjoining recess 52 is set in such a manner as to depend on the clearance between the two projections 122. In the embodiment it is defined according to the following procedure.

First, it is supposed that a distance between the two projections 122 is D1. A linear distance between one recess 52 (hereinafter, "recess 52(A)" for easier understanding) and a second recess 52 (hereinafter, "recess 52(B) for easier understanding) from the recess 52(A) (not including the recess 52(A) for counting) is caused to match with D1. Next, a recess 52(C) is arranged at the midpoint between the recess 52(A) and the recess 52(B). Note that because the recesses 52 are arranged on the circumference of the circle in the embodiment, the recess 52(C) is also arranged in this manner.

In this case, a distance between the adjoining recesses 52 and along the foregoing circumference becomes $R\cdot(\mathrm{Sin}^{-1}(D1/2R))$, where R is the foregoing constant radius, i.e., the radius of the circle having the circumference on which the recesses 52 are arranged.

Because the relationship between the projections 122 and the recesses 52 is defined in this manner, the two projections 122 can engage with the respective two recesses 52 at the same time. In this state, as shown in FIG. 1, there is one recess 52 between the left projection 122 and the right projection 122. Here, let us use the foregoing reference numbers 52(A), 52(B), and 52(C), then the projections 122 engage with the recess 52(A) and the recess 52(B), respectively (see, black circles in FIG. 1), and there is the recess 52(C) not subjected to engagement.

The distance between the projections 122 and the distance between the adjoining recesses 52 have an interactive correlation, so that it is proper that, contrary to the explanation mentioned above, the distance between the adjoining recesses 52 may be first defined, and then based on this, the distance between the projections 122 may be defined (in other words, the size of the elastic member 121 itself, or the size of the lower member 1 may be defined).

In addition, as shown in FIG. 1 or FIG. 7, the upper member 2 has a hook-up opening 23. This hook-up opening 23 can be used to hook the portable-device holding clip on a member protruding from some buildings or the wall thereof.

Next, with reference to FIGS. 11A to 11C, in addition to already referred FIGS. 1 to 10A and 10B, the operation of the portable-device holding clip employing the above described structure will be explained.

Figure 11A:
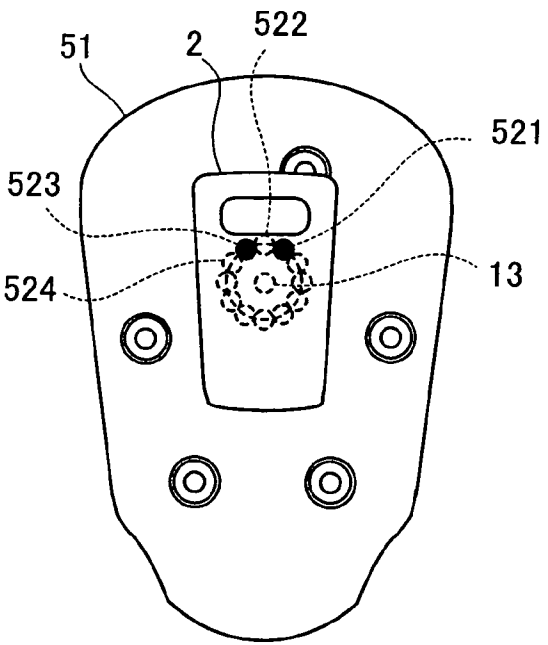
FIGS. 11A to 11C are diagrams for explaining the operation of the portable-device holding clip according to the embodiment of the present invention.
Figure 11B:
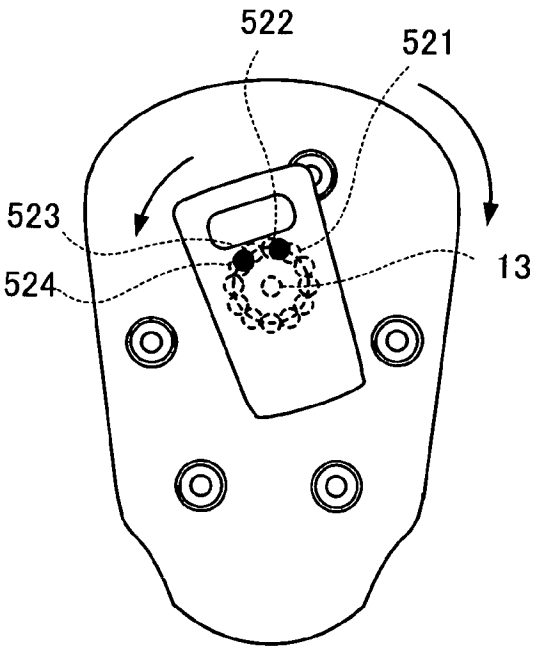
Figure 11C:
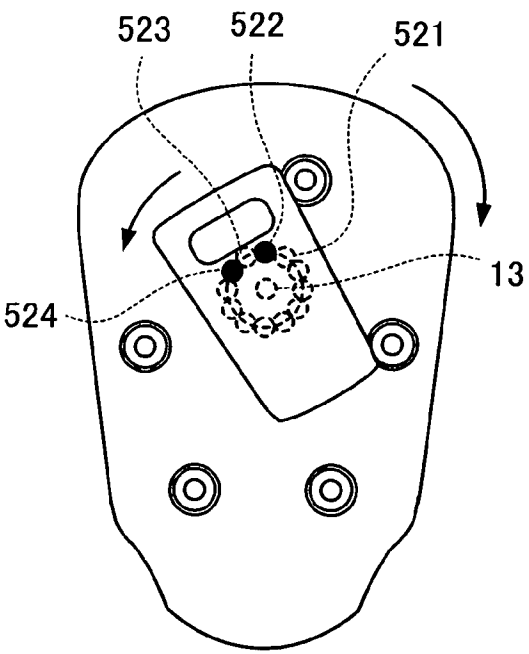

FIGS. 11A to 11C illustrate the way how the lower member 1 and the upper member 2 (hereinafter, they may be combined together and simply called a "clip" to make the explanation simple) rotate around the rotation shaft 13 with respect to the rear panel 51 counterclockwise, from the left to the right.

The clip and the rear panel 51 have a relative relationship regarding rotation, so that it is possible to understand that FIGS. 11A to 11C illustrate the way how the rear panel 51 rotates with respect to the clip. In the following explanation, an explanation will be given with reference to FIGS. 11A to 11C from the standpoint that "the clip rotates", but the explanation includes a meaning such that "the rear panel 51 (or the portable device fixed thereto) rotates".

FIG. 11A, which has no difference with FIG. 1, shows that the clip takes a normal posture with respect to the rear panel 51. In this situation, recesses 521 and 523, shown in FIGS. 11A to 11C, in the recesses 52 formed in the attachment surface 51A of the rear panel 51 engage with the respective projections 122 of the lower member 1 (see, black circles in the figure).

Next, from this situation, the clip is slightly rotated counterclockwise. At this time, the elastic member 121 of the lower member 1 functions. The mechanism thereof is as follows.

When the clip starts rotating, the leading end of the projection 122 receives force from the inside surface of the recess 521 which gradually becomes shallow. This is because the recess 521 is formed in an approximately semispherical shape. This force is applied in a direction in which the projection 122 is caused to move toward you from FIGS. 11A to 11C. Then, because the projection 122 is formed at the leading end of the elastic member 121 of the lower member 1, the leading end of the elastic member 121 also receives the force in the same direction. At this time, the leading end of the elastic member 121 can make a motion in this direction. This is because the elastic member 121 can warp with the linkage portion 124 taken as an axis, as explained above (see, FIG. 5).

When the rotation of the clip further progresses, the leading end of the projection 122 reaches a portion between the adjoining recesses 521 and 522 which is like a "peak" of a mountain. This peak is a portion where the inside surface of one recess 521 encounters that of the other recess 522. The amount of warping of the leading end of the elastic member 121 at this time becomes maximum. FIG. 11B shows a situation where the projection 122 is on the peak between the recesses 521 and 522.

The above described mechanism also applies to the projection 122 which moves between the recesses 523 and 524 in FIGS. 11A to 11C.

Subsequently, from the situation shown in FIG. 11B, the clip is further rotated counterclockwise.

Then, the projection 122 located at the peak between the recesses 521 and 522 as explained above slides the inside surface of the recess 522, and engages with the recess 522.

That is, the projection 122 moves toward the insides of FIGS. 11A to 11C. This is because elastic force which causes the elastic member 121 in a warped state to return to the original state is applied to the leading end of the elastic member 121, i.e., the projection 122. This elastic force is generated from the linkage portion 124 as one of the sources. Moreover, according to the foregoing structure, the elastic body 3 serves as one of the source of the elastic force (see, attachment holes 321 in FIG. 9 and attachment protrusions 123 in FIG. 4).

As shown in FIG. 11C, the projection 122 rapidly and surely engages with the recess 522. The expression "rapidly and surely" is under consideration of a fact that not only elastic force from the elastic member 121 but also elastic force of the elastic body 3 exert in engagement of the projection 122 with the recess 522. The above described mechanism is also true for the projection 122 which moves between the recesses 523 and 524 in FIGS. 11A to 11C.

Meanwhile, a click sound is generated when the projection 122 engages with the recess 52, and a user can feel clicking.

According to the embodiment, the clip can be easily rotated with respect to the portable device, or the portable device can be rotated with respect to the clip in the foregoing manner, and fixing of the posture of the portable device in a predetermined rotation angle can be surely carried out.

According to the portable-device holding clip of the embodiment having the foregoing structure and working, the following effectiveness can be obtained.

(1) According to the portable-device holding clip of the embodiment, elastic force generated by the elastic member 121 which is formed integral with the lower member 1 is used for fixing the rear panel 51, and the posture of the portable device fixed thereto. Therefore, according to the embodiment, a structure of the portable-device is simplified in comparison with a case where particular parts, members, and the like are used for fixing the posture, so that increment of cost inherent to increment of the number of parts can be avoided.

The structure facilitates assembling of the portable-device holding clip of the embodiment. Further, the effectiveness of the structure facilitates disassembling, replacement, and reassembling of the portable-device holding clip when the upper member 2 and the elastic body 3 are damaged.

Figure 17A:
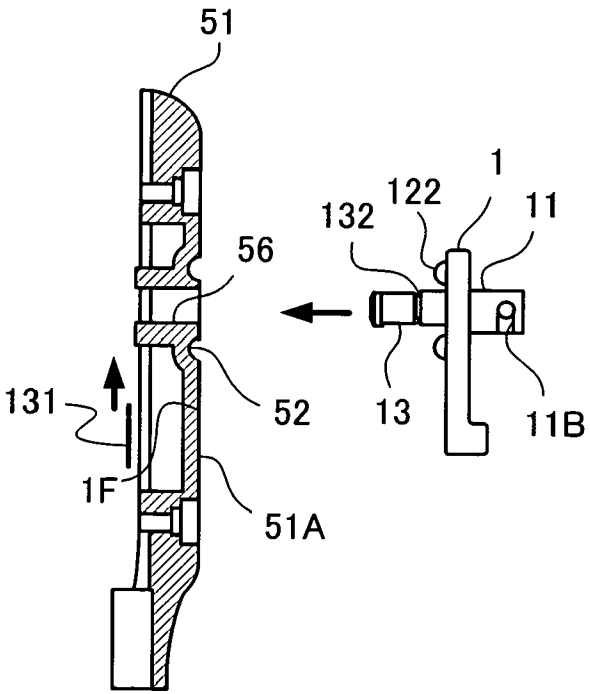
FIGS. 17A to 17C are diagrams showing an example of a method of assembling the portable-device holding clip.
Figure 17B:
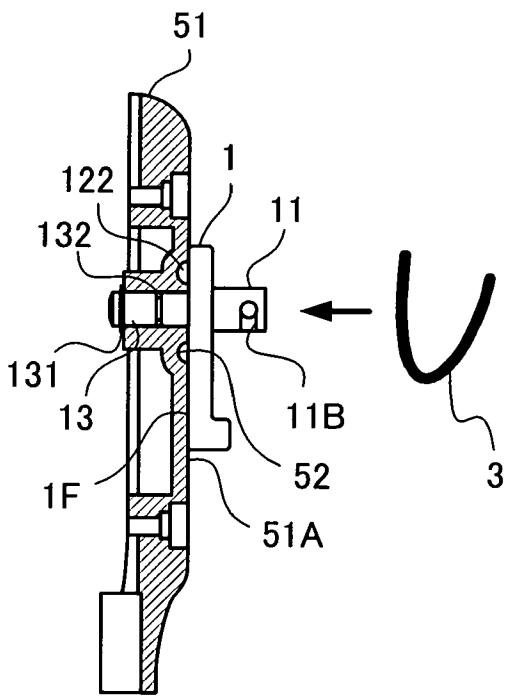
Figure 17C:
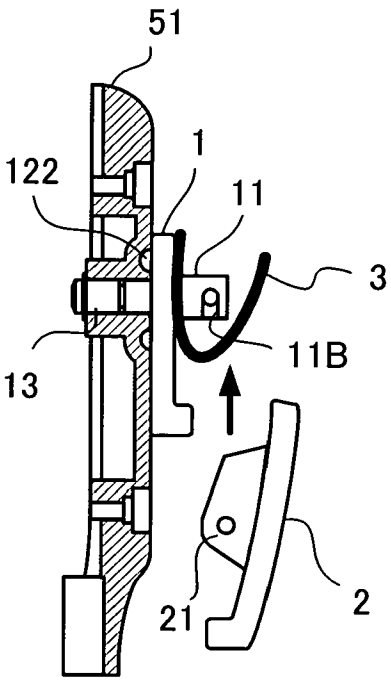

FIGS. 17A to 17C is a diagram showing an example of a method of assembling the clip. First, as shown in FIG. 17A, the rotation shaft 13 of the lower member 1 is inserted into the through hole 56 of the rear panel 51, and then the E ring 131 is fitted into the outward groove of the rotation shaft 13 perpendicularly to the axis. In this state, the attachment surface 51A of the rear panel 51 faces the attachment surface 1F of the lower member 1, and the rotation shaft 13 completely passes through the rear panel 51. The rear panel 51 is supported by the rotation shaft 13, and the rear panel 51 and the lower member 1 become able to relatively rotate around the rotation shaft 13. Next, as shown in FIG. 17B, the elastic body 3 is attached to the elastic member 121 of the lower member 1. As shown in FIG. 9, the elastic body 3 is attached in such a way that the attachment protrusions 123 engage with the respective lower-member attachment holes 321. Finally, as shown in FIG. 17C, the second coupler 21 of the upper member 2 is fitted in the first coupler 11 of the lower member 1 in a sliding manner from the gripping portion side so that the leaf spring is held down. At this time, the protrusions of the upper member 2 are engaged with the upper-member attachment groove 322 of the elastic body 3. The clip shown in FIG. 2 is then assembled through the foregoing method.

The effectiveness such that assembling is easy becomes more effective because the portable-device holding clip of the embodiment has the first coupler 11 comprising a groove 11B and the second coupler 21. This is because a structure which realizes very simple assembling such that the protrusions 21A is caused to pass through the respective grooves 11B, thereby engaging with the engagement holes 11A is employed as mentioned above.

According to such a structure, ease of assembling is improved in comparison with a case where an additional pin is used for coupling the two members, and the cost to be necessary for preparing the additional pin can be saved.

(2) According to the portable-device holding clip of the embodiment, high operability is provided. This is because the projection 122 and the recess 52 are disengaged relatively easily or smoothly when the clip is rotated or is in rotation, as mentioned above with reference to FIG. 11.

There are some reasons for smooth disengagement of the projection 122 and the recess 52.

First, with reference to FIG. 3, because the elastic member 121 has the integrity with lower member 1, the projection 122 used for fixing the posture of the portable device merely protrudes from the attachment surface 1F of the lower member 1, and as a result, the projection 122 is relatively easily disengaged from the recess 52 by merely applying force which rotates the lower member 1 as a solid body and the upper member 2 coupled thereto.

Second, because the lower member 1 and the elastic member 121 of the embodiment are each formed of a resin material, the linkage portion 124 has a relatively large elastic deformation capability, so that the elastic member 121 can be warped relatively easily.

Third, projection 122 and recess 52 have an approximately semispherical shape, in relative rotation of the rear panel 51 and the lower member 1, there is no specific disturbance for disengagement of the projection 122 from the recess 52, so that disengagement is carried out smoothly. This is obvious in comparison with a case where the projection 122 and the recess 52 are formed in a cubic shape, or a rectangular-solid-like shape.

Regarding the first reason, it is preferable that the size of the lower member 1 as a solid body, the size of the structure (i.e., clip) constituted by the lower member 1 and the upper member 2, or the height of the clip from the attachment surface 51A should be large as much as possible in comparison with the protrusive length of the projection 122 from the attachment surface 1F from the standpoint of easy disengagement of the projection 122 from the recess 52. This facilitates application of large rotational force to the clip or the lower member 1; thus facilitating the disengagement mentioned above. However, the foregoing sizes and height should be set to values appropriate with respect to the size of the rear panel 51 or the portable device.

(3) As mentioned above, according to the portable-device holding clip of the embodiment, disengagement of the projection 122 from the recess 52 is carried out relatively easily, the high operability is obtained, and the posture of the portable device is surely fixed.

This is because the posture of the portable device is fixed by engagement of the projection 122 which is the leading end of the elastic member 121 with the recess 52, and exertion of elastic force originating from the elastic body 3 on that engagement. That is, according to the embodiment, two elastic forces that is elastic force of the elastic member 121 (i.e., linkage portion 124) and elastic force of the elastic body 3 are used for fixing the posture of the portable device, so that the fixing of the posture thereof is ensured.

According to the embodiment, there are the two projections 122 which engage with the recess 521 and the recess 523 (or, the recess 522 and the recess 524), respectively, as explained above with reference to FIGS. 11A to 11C. This greatly contributes to surely fixing the posture of the portable device. It can be said that the specific mode where the two projections 122 engage with the respective recesses 52 which sandwich one recess 52 therebetween as shown in FIG. 1 or FIG. 11 is an extremely suitable mode for maintaining the well-balanced posture of the portable device. The superiority of the embodiment is obvious in comparison with a case where there is only one projection and one recess with which the projection engages.

The presence of the elastic body 3 which applies elastic force to the elastic member 121 provides the following effectiveness.

That is, the elastic member 121 of the embodiment is always required to do warping when the portable device is rotated, and is formed of a resin material, so that the linkage portion 124 of the elastic member 121 is a portion which is likely to be damaged. However, even if the linkage portion 124 is damaged, the presence of the elastic body 3 takes cover the absence of the elastic member 121, so that there is an advantage such that it is no problem to keep using the clip.

(4) According to the embodiment, the recess 52 is directly formed in the rear panel 51 to form the attachment surface 51A, it is superior from the standpoint of waterproofing in comparison with a case where the attachment surface 51A is formed of a separate member (e.g., metallic panel). Because the sufficient and effective waterproof effect can be obtained in the embodiment by merely providing the O ring 132 in the groove of the rotation shaft 13 as shown in FIG. 2. On the other hand, when the attachment surface 51A is formed of a separate member, it is necessary to perform waterproofing on the entire periphery of the separate member (e.g., if the metallic panel is formed in a rectangular shape, waterproofing should be performed on all four sides).

Using the separate member brings out an advantage such that it is possible to prevent the projection 122 from scratching the surface of the attachment surface 51A, but an almost same effectiveness can be obtained according to the embodiment by devising a countermeasure like setting a predetermined clearance between the attachment surface 51A and the attachment surface 1F. As more specific realization means, a scheme of attaching a washer to the rotation shaft 13 and disposing the washer between the attachment surface 51A and the attachment surface 1F can be employed.

Not forming the attachment surface from the separate member brings out the following effectiveness in the embodiment. That is, the portable device, a front panel, or the like (not shown, all are represented by a "front panel" in this paragraph) is attached to the rear panel 51. In this case, the rear panel 51 and the front panel are fixed together by, for example, screws.

At this time, if the separate member is present, it is obvious that screwing cannot be performed on that region where the separate member is present. That is, if the separate member is present, there is a large limitation for setting of screwing positions.

In contrast, according to the embodiment, because there is no separate member, the screwing position can be basically set freely on the attachment surface 51A of the rear panel 51. Screwing can also be performed on a portion of the attachment surface 51A which is hidden by the clip but is exposed by rotating the clip.

Moreover, according to the embodiment, it becomes possible to appropriately set the screwing positions in consideration of a substantive effect such that the rear panel 51 and the front panel are firmly coupled together. As a result, according to the embodiment, not only an effectiveness on designing such that the degree of freedom for setting the screwing positions is improved, but also other effects (e.g., firmly coupling the rear panel 51 and the front panel together) obtained in consideration of the substantive effect can be also obtained.

The present invention can be applied to the embodiment where the separate member is used, and there is no intention to positively exclude such application.

The present invention is not limited to the foregoing embodiment, and can be modified in various forms. The followings are examples of the modification.

(1) First, according to the foregoing embodiment, the leaf spring is provided as the elastic body 3, but the present invention is not limited to this case. For example, as shown in FIGS. 12 to 16, an elastic body 320 as a coil spring having coil portions 32 can be used. Note that FIGS. 12 to 16 correspond to FIGS. 2, 4, 7, 8 and 9, respectively.

Figures 16A, 16B:
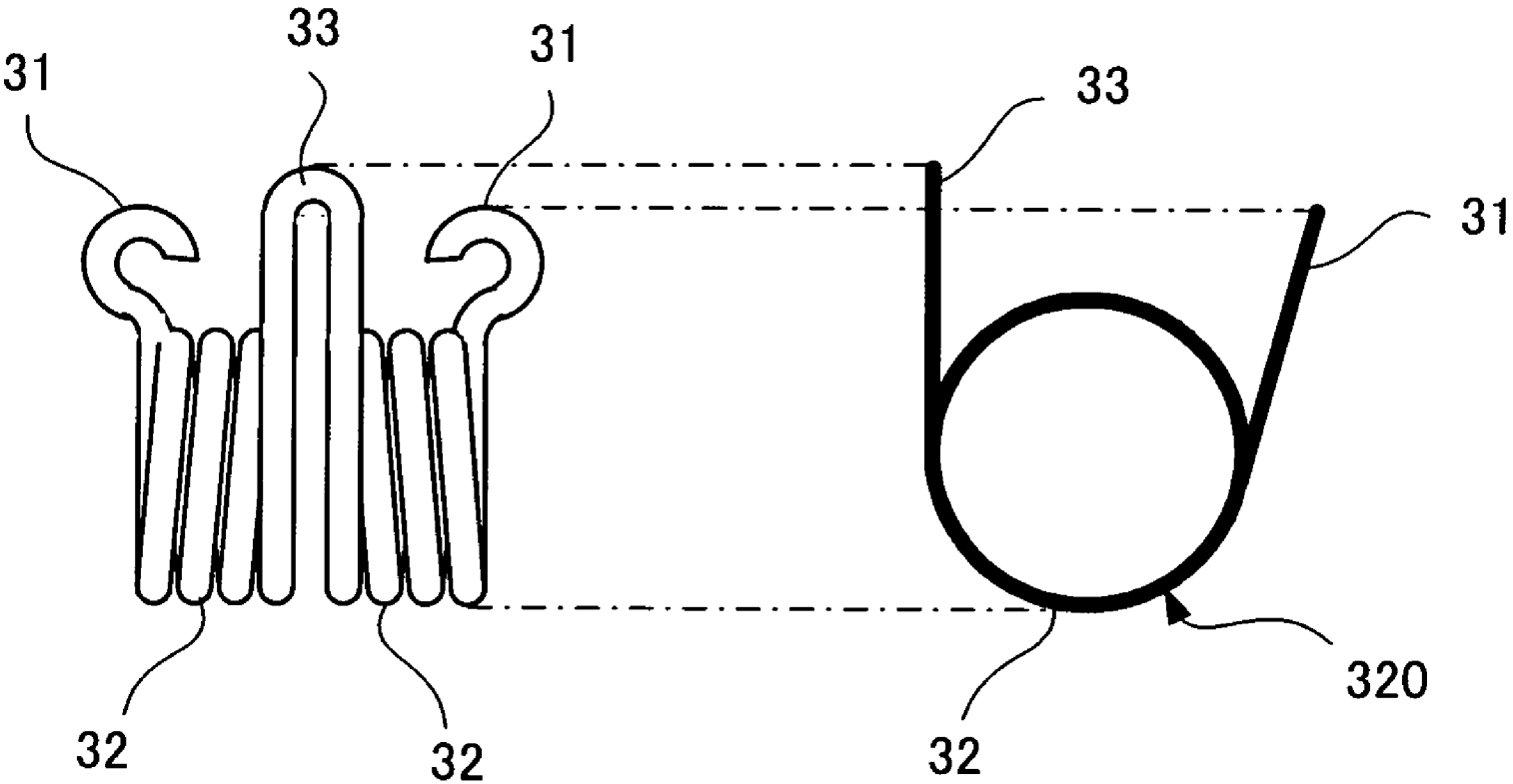
FIG. 16A is a top plan view of an elastic body of the portable-device holding clip in FIG. 12.
FIG. 16B is a side view thereof.

As shown in FIG. 16, the elastic body 320 has attachment portions 31, coil portions 32, and abutting portion 33 which abuts with the lower member 1.

Figure 15:
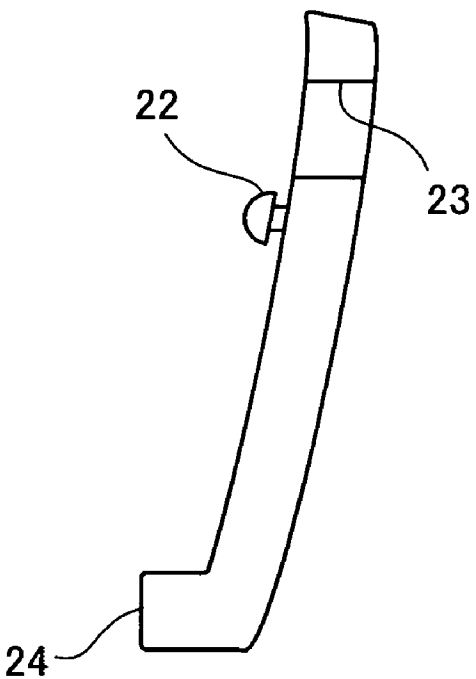
FIG. 15 is a cross-sectional view showing the upper member of the portable-device holding clip in FIG. 12.
Figure 14:
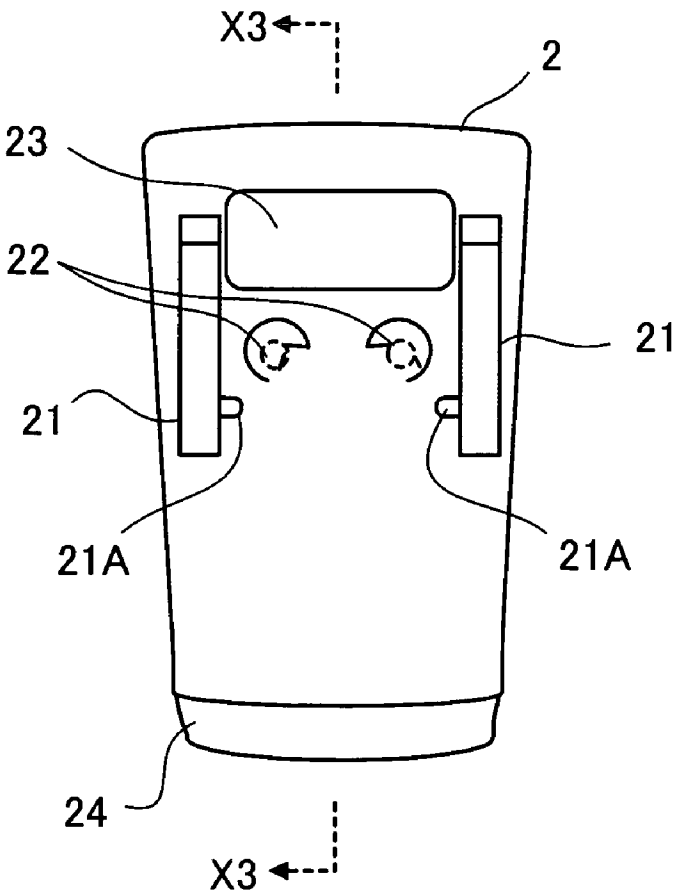
FIG. 14 is a top plan view showing an upper member of the portable-device holding clip in FIG. 12.

As shown in FIG. 16, each attachment portion 31 is formed in a circular shape having a circumference partially cut. The attachment portions 31 having such a shape are hooked to respective attachment protrusions 22 each of which is formed on the upper member 2 and is formed in a mushroom-like shape on the whole as shown in FIGS. 14 and 15. Note that dashed lined around the attachment protrusions 22 represent a position where the attachment portions 31 locate when the attachment portions 31 are hooked to the attachment protrusions 22.

Figure 13:
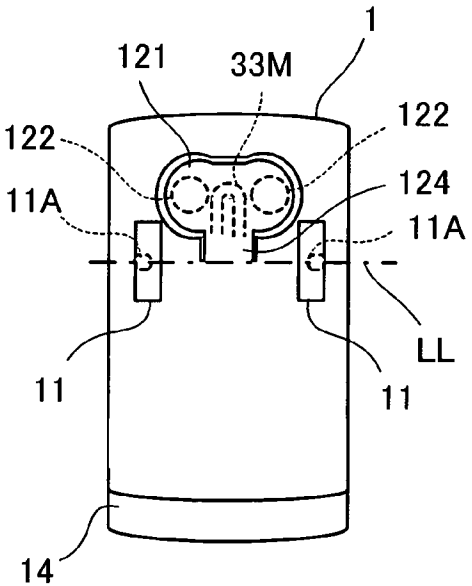
FIG. 13 is a top plan view showing a lower member of the portable-device holding clip in FIG. 12.
Figure 12:
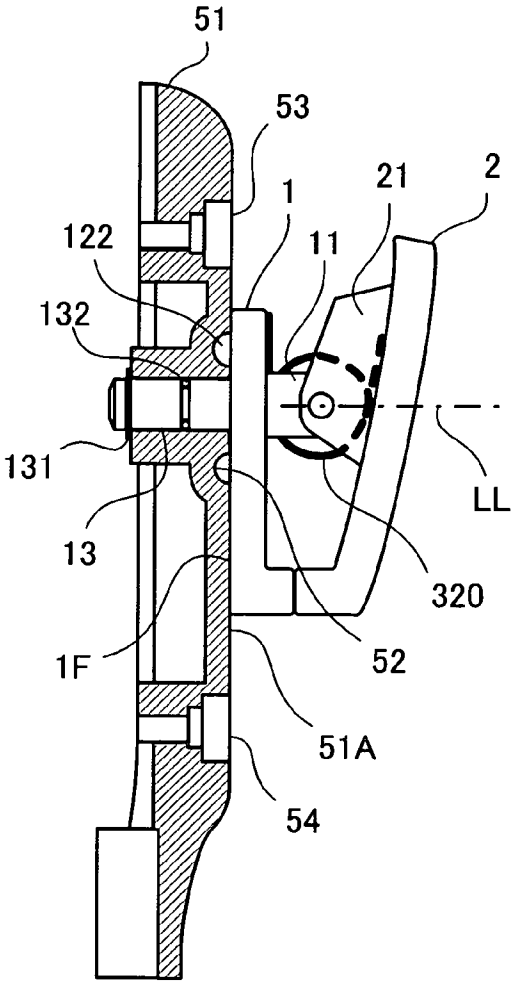
FIG. 12 is a side view (partially cross-sectional view) showing a portable-device holding clip according to another embodiment of the present invention.

The abutting portion 33, on the other hand, is formed in an approximately letter U shape. As shown in FIG. 12 or FIG. 13, the abutting portion 33 abuts with the wide face of the lower member 1. Note that dashed line 33M drawn in such a manner as to run across the center line running in the vertical direction represents a portion where the abutting portion 33 abuts with the lower member 1.

The coil portions 32 are formed integral with the attachment portions 31 and the abutting portion 33, and store an elastic energy. Storing of the elastic energy is carried out by applying predetermined force to the attachment portions 31 and the abutting portion 33 when the elastic body 320 is attached between the lower member 1 and the upper member 2. Because of the presence of the coil portions 32, elastic forces are applied to both lower member 1 and upper member 2. The direction of elastic force working between the respective lower ends of the lower member 1 and the upper member 2 and that of elastic force working between the upper ends are just opposite, like the foregoing embodiment.

It is apparent that such a modified embodiment can achieve substantially same working and effectiveness as those of the foregoing embodiment.

According to the modified embodiment, particularly, working and effectiveness such that the clip can withstand repeating of use is obtained. That is, in comparison with the elastic body 3 of the foregoing embodiment, improvement of the durability of the elastic body can be expected.

However, because the elastic body 320 employs a complicated structure in comparison with that of the foregoing embodiment, the foregoing embodiment is superior from the standpoint of effectively obtaining the effectiveness, such as simplification of the structure, cost reduction, and facilitation of assembling.

As an another modified embodiment different from the foregoing modified embodiment, a leaf spring, a torsion coil spring, a tension coil spring, or a combination thereof which clips the lower ends of the lower member 1 and the upper member 2 directly and inwardly and applies elastic force which causes both lower ends to come close together may be employed. On the other hand, in a case where there is a point of application of elastic force on the upper ends of the lower member 1 and the upper member 2 like the foregoing embodiment, a leaf spring, torsion coil spring, a compression coil spring or a combination thereof can be used as the elastic body 3. Further, in a case where elastic force of the elastic body 3 directly works on the elastic member 121, the projection 122 of the lower member 1 is pressed against the rear panel 51 by the elastic body 3, thereby firmly fixing the projection 122 in the recess of the rear panel 51. As a result, the posture of the portable device is surely fixed.

(2) In the foregoing embodiment, the elastic member 121 and the attachment surface 51A of the rear panel 51 respectively have the projection 122 and the recess 52, but this relationship may be inverted in some instances. That is, the elastic member 121 may have the recess, while the attachment surface 51A of the rear panel 51 may have the projection.

(3) In the foregoing embodiment, the explanation has been given of the case where the lower member 1 and the elastic member 121 are integrally formed together, but the present invention is not limited to this case. The integral structure of the lower member 1 with the elastic body 121 can be obtained by a scheme of, for example, forming an opening in a predetermined portion of the lower member beforehand, forming the "elastic member" separately, retaining the "elastic member" in the opening, and connecting an edge of the "elastic member" and an edge of the opening together, thereby forming the linkage portion.

(4) In the foregoing embodiment, all of the lower member 1, the upper member 2 and the rear panel 51 are formed of the resin materials, but the present invention is not limited to this case. For example, all or some of them may be formed of metallic materials.

(5) In the foregoing embodiment, there is the expression "the portable device is fixed to the rear panel 51", but according to the present invention, there is no intention to set the rear panel 51 and the portable device in a specific relationship with that expression. According to such an expression, it is possible to interpret that the rear panel 51 is an independent member, and the portable device is present separately from the rear panel 51, but it is also possible to interpret that the rear panel 51 is present as a part of the portable device. In this case, an expression "the portable device 'main body' is fixed to the rear panel 51", or an expression "'portions of the portable device other than the rear panel 51' are fixed to the rear panel 51" is more accurate instead of the foregoing expression.

Anyway, it is not an essential part of the present invention, and it should be understood that an embodiment where the rear panel 51 constitutes a part of the portable device and an embodiment where the rear panel 51 does not constitute the part of the portable device are within the scope of the invention.

The term "portable device" in claims should be interpreted under consideration of the above described circumstances.

According to the present invention, a first member and a second member serve as a clip which is attachable to and detachable from a certain object like a clothing.

According to the present invention, an elastic member is arranged in such a manner as to be retained in an opening in an opposed surface of the first member, and a projection provided at the leading end of the elastic member is used for fixing the posture of a rotatable portable device. That is, according to the invention, it is not necessary to prepare any particular members for posture fixing, and using the elastic member which constitutes a part of the first member enables the posture fixing. Therefore, according to the invention, the structure can be simplified. Because the structure is simplified, cost reduction, facilitation of assembling, reduction in weight, and the like can be achieved according to the invention.

Moreover, according to the present invention, to rotate the portable device with respect to the first member, for example, a user can rotate the portable device by merely grabbing the first member (or the second member coupled to the first member, in addition thereto) by the right hand, grabbing the portable device by the left hand, and twisting them. This is because it is possible to expect from the foregoing relationship between the first member and the elastic member that only the projection protrudes from the opposed surface of the first member, and if so, it is relatively easy to disengage the projection from a recess due to warping of the elastic member by only applying, for example, force which causes the first member (or the second member) as a solid body to rotate. This is extremely advantageous in comparison with conventional structures which require operations having different vectors at the same time.

As explained above, according to the present invention, an extremely good operability can be obtained.

This effectiveness can be further effectively obtained when (1) the first member is formed of a resin material, and (2) the projection and the recess each have an approximately semi-spherical shape, and the like. According to the factor (1), warping is facilitated, and according to the factor (2), disengagement of the projection from the recess when the portable device is rotated with respect to the first member becomes smooth.

Various embodiments and changes may be made thereunto without departing from the broad spirit and scope of the present invention. The above described embodiments are intended to illustrate the present invention, not to limit the scope of the present invention. The scope of the present invention is shown by the attached claims rather than the embodiments. Various modifications made within the meaning of an equivalent of the claims of the present invention and within the claims are to be regarded to be in the scope of the present invention.

This application is based on Japanese Patent Application No. 2007-008768 filed on Jan. 18, 2007 and including specification, claims, drawings and summary. The disclosure of the above Japanese Patent Application is incorporated herein by reference in its entirety.

What is claimed is:

1. A portable-device holding clip that holds a portable device and is attachable to and detachable from a certain thin object, comprising:

a first member which has a first gripping portion and holds the portable device;

a second member having a second gripping portion which can abut against the first gripping portion with the certain thin object in between; and an elastic body generating elastic force which is applied between the first gripping portion and the second gripping portion and causes the first gripping portion and the second gripping portion to come in contact with each other; and wherein the first member further has:

an attachment portion having an opposed surface which faces an attachment surface of the portable device;

a rotation shaft which is attached to the attachment portion, passes through the attachment surface of the portable device, and holds the portable device in such a way that the portable device is rotatable around an axis of the rotation shaft with respect to the first member;

an elastic member having a linkage portion which constitutes a part of a contour of the elastic member, and is connected to the opposed surface or a surface connected to the opposed surface in a elastically deformable manner; and a projection which can engage with one of a plurality of recesses formed in the attachment surface in such a manner as to be arranged on a circular arc away from a center of the rotation shaft by a predetermined distance, and is provided at a leading end of the elastic member, the elastic member is arranged in such a manner as to be retained in an opening formed in the opposed surface and formed in a shape corresponding to the contour of the elastic member, and is able to warp with respect to the opposed surface around the linkage portion, and the projection is disengaged from the recess by warping of the elastic member or engaged with the recess by a retroaction of the warping when the portable device is rotated with respect to the first member, and wherein elastic force originating from the elastic body exerts on the elastic member at least when the projection engages with the recess.

2. The portable-device holding clip according to claim 1, wherein the first member and the elastic member are formed by integral molding.

3. The portable-device holding clip according to claim 1, wherein the first member is made of a resin material.

4. The portable-device holding clip according to claim 1, wherein the projection and the recess are both formed in an approximately semispherical shape.

5. The portable-device holding clip according to claim 4, wherein a plurality of projections are provided at the leading end of the elastic member, and the plurality of projections can engage with the respective recesses at a same time.

6. The portable-device holding clip according to claim 1, further comprising a coupler means which couples the first member and the second member together in such a way that the first member and the second member are rotatable around a predetermined axis, and wherein the first gripping portion and the second gripping portion are located at respective one side ends of the first member and the second member with the predetermined axis taken as a boundary, and the elastic body applies elastic force, which causes the first member and the second member to be apart from each other, between respective other sides of the first member and the second member with the predetermined axis taken as a boundary.

7. The portable-device holding clip according to claim 6, wherein the coupler means has first and second protrusions provided at either one of the first member and the second member, first and second engagement holes provided in an other one of the first member and the second member and engaged with the first and second protrusions, respectively, and first and second grooves communicated with the first and second engagement holes, respectively, and each having a width through which the first or second protrusion can pass, the protrusion passes through the groove to engage with the engagement hole, and an engagement portion where the first protrusion engages with the first engagement hole and an engagement portion where the second protrusion engages with the second engagement hole are present on the predetermined axis.

8. The portable-device holding clip according to claim 1, further comprising a coupler structure which couples the first member and the second member together in such a way that the first member and the second member are rotatable around a predetermined axis, and wherein the first gripping portion and the second gripping portion are located at respective one side ends of the first member and the second member with the predetermined axis taken as a boundary, and the elastic body applies elastic force, which causes the first member and the second member to be apart from each other, between respective other sides of the first member and the second member with the predetermined axis taken as a boundary.

9. The portable-device holding clip according to claim 8, wherein the coupler structure has first and second protrusions provided at either one of the first member and the second member, first and second engagement holes provided in an other one of the first member and the second member and engaged with the first and second protrusions, respectively, and first and second grooves communicated with the first and second engagement holes, respectively, and each having a width through which the first or second protrusion can pass, the protrusion passes through the groove to engage with the engagement hole, and an engagement portion where the first protrusion engages with the first engagement hole and an engagement portion where the second protrusion engages with the second engagement hole are present on the predetermined axis.

10. The portable-device holding clip according to claim 1, further comprising a coupler portion which couples the first member and the second member together in such a way that the first member and the second member are rotatable around a predetermined axis, and wherein the first gripping portion and the second gripping portion are located at respective one side ends of the first member and the second member with the predetermined axis taken as a boundary, and the elastic body applies elastic force, which causes the first member and the second member to be apart from each other, between respective other sides of the first member and the second member with the predetermined axis taken as a boundary.

11. The portable-device holding clip according to claim 10, wherein the coupler portion has first and second protrusions provided at either one of the first member and the second member, first and second engagement holes provided in an other one of the first member and the second member and engaged with the first and second protrusions, respectively, and first and second grooves communicated with the first and second engagement holes, respectively, and each having a width through which the first or second protrusion can pass, the protrusion passes through the groove to engage with the engagement hole, and an engagement portion where the first protrusion engages with the first engagement hole and an engagement portion where the second protrusion engages with the second engagement hole are present on the predetermined axis.

12. The portable-device holding clip according to claim 1, wherein the first member and the second member respectively comprise a solid body formed in an approximately rectangular-solid-like shape.

13. The portable-device holding clip according to claim 1, wherein a plurality of projections are provided at the leading end of the elastic member, and the plurality of projections can engage with the respective recesses at a same time.

14. The portable-device holding clip according to claim 1, wherein the elastic body comprises a leaf spring.

15. The portable-device holding clip according to claim 1, wherein the elastic body comprises a coil spring.

* * * * *